US011692386B2

(12) United States Patent
Herthan et al.

(10) Patent No.: US 11,692,386 B2
(45) Date of Patent: Jul. 4, 2023

(54) VEHICLE WITH A DEVICE FOR MANUALLY AND/OR ELECTROMOTIVELY ADJUSTING A VEHICLE DOOR RELATIVE TO A VEHICLE BODY

(71) Applicant: Brose Fahrzeugteile SE & Co. Kommanditgesellschaft, Bamberg, Bamberg (DE)

(72) Inventors: Bernd Herthan, Michelau (DE); Alexander Müller, Bischberg (DE); Stefan Bickel, Bamberg (DE)

(73) Assignee: Brose Fahrzeugteile SE & Co. Kommanditgesellschaft, Bamberg

( * ) Notice: Subject to any disclaimer, the term of this patent is extended or adjusted under 35 U.S.C. 154(b) by 91 days.

(21) Appl. No.: 17/055,895

(22) PCT Filed: May 9, 2019

(86) PCT No.: PCT/EP2019/061962

§ 371 (c)(1),
(2) Date: Nov. 16, 2020

(87) PCT Pub. No.: WO2019/219508

PCT Pub. Date: Nov. 21, 2019

(65) Prior Publication Data

US 2021/0198935 A1 Jul. 1, 2021

(30) Foreign Application Priority Data

May 16, 2018 (DE) ..... 10 2018 111 756.6
Feb. 14, 2019 (DE) ..... 10 2019 201 978.1

(51) Int. Cl.
*E05F 15/00* (2015.01)
*E05F 15/73* (2015.01)
(Continued)

(52) U.S. Cl.
CPC ..... *E05F 15/73* (2015.01); *E05C 17/003* (2013.01); *E05F 15/627* (2015.01); *E05F 15/63* (2015.01);
(Continued)

(58) Field of Classification Search
CPC ..... E05F 15/73; E05F 15/63; E05F 15/627; E05F 15/70; E05Y 2201/21;
(Continued)

(56) References Cited

U.S. PATENT DOCUMENTS 4,674,230 A 6/1987 Takeo et al.
2009/0100755 A1* 4/2009 Ishihara ..... E05F 15/46 49/31
(Continued)

FOREIGN PATENT DOCUMENTS

DE 102015215627 A1 2/2017
EP 2905410 A1 8/2015

*Primary Examiner* — Chi Q Nguyen
(74) *Attorney, Agent, or Firm* — Dickinson Wright PLLC

(57) ABSTRACT

A vehicle door arranged on a vehicle body and a device for manually and/or electromotively adjusting the vehicle door relative to the vehicle body including an output element moved on adjustment of the vehicle door and a switching device configured to switch between a coupling state and a freewheeling state, and a control device. The switching device configured to couple the output element to a further assembly in the coupling state and to disengage it from the further assembly in the freewheeling state such that the output element is movable with respect to the further assembly. At least one sensor device configured to detect a signal indicating an occupant's wish to get out of the vehicle, and configured to evaluate the signal for detecting an exit wish and actuate the switching device to switch into the coupling state.

20 Claims, 8 Drawing Sheets

(51) Int. Cl.
*E05F 15/627* (2015.01)
*E05F 15/63* (2015.01)
*E05C 17/00* (2006.01)

(52) U.S. Cl.
CPC ..... *E05Y 2201/21* (2013.01); *E05Y 2201/214* (2013.01); *E05Y 2201/218* (2013.01); *E05Y 2201/418* (2013.01); *E05Y 2201/702* (2013.01); *E05Y 2201/704* (2013.01); *E05Y 2400/20* (2013.01); *E05Y 2400/44* (2013.01); *E05Y 2400/59* (2013.01); *E05Y 2800/11* (2013.01); *E05Y 2900/531* (2013.01)

(58) Field of Classification Search
CPC ..... E05Y 2800/11; E05Y 2201/214; E05Y 2201/418; E05Y 2400/44; E05Y 2400/59; E05Y 2201/218; E05Y 2201/704; E05Y 2400/20; E05Y 2900/531; E05C 17/003
USPC ..... 49/31
See application file for complete search history.

(56) References Cited

U.S. PATENT DOCUMENTS

2016/0355127 A1* 12/2016 Compton ..... B60Q 9/00
2017/0030737 A1* 2/2017 Elie ..... E05F 15/42
2017/0081894 A1* 3/2017 Kobayashi ..... E05F 15/659
2017/0247927 A1* 8/2017 Elie ..... B60R 16/033
2017/0292311 A1* 10/2017 Podkopayev ..... E05C 17/006
2018/0051502 A1* 2/2018 Roos ..... E05B 81/14
2018/0155968 A1* 6/2018 Miu ..... E05C 17/006
2018/0223583 A1* 8/2018 Podkopayev ..... F16H 25/20
2018/0238099 A1* 8/2018 Schatz ..... E05F 15/622
2018/0266160 A1* 9/2018 Bito ..... E05B 85/243
2019/0376333 A1* 12/2019 Rrumbullaku ..... E05F 15/46
2020/0002990 A1* 1/2020 Kawase ..... B61D 19/026

* cited by examiner

VEHICLE WITH A DEVICE FOR MANUALLY AND/OR ELECTROMOTIVELY ADJUSTING A VEHICLE DOOR RELATIVE TO A VEHICLE BODY

CROSS-REFERENCE TO RELATED APPLICATIONS

This application is the U.S. National Phase of PCT Application No. PCT/EP2019/061962 filed on May 9, 2019, which claims priority to German Patent Application Nos. DE 10 2018 111 756.6, filed on May 16, 2018 and DE 10 2019 201 978.1, filed on Feb. 14, 2019, the disclosures of which are hereby incorporated in their entirety by reference herein.

TECHNICAL FIELD

This present disclosure relates to a vehicle door adjustment system.

BACKGROUND

Such a vehicle may include a vehicle door which is adjustably, in particular pivotally, arranged on a vehicle body, a device for manually and/or electromotively adjusting the vehicle door relative to the vehicle body and a control device for controlling the device.

Such a device for example serves for electromotively adjusting the vehicle door relative to the vehicle body, but under certain circumstances will provide for a manual adjustment of the vehicle door.

SUMMARY

One or more objects of the present disclosure may be to provide a vehicle occupant in a vehicle with a simple, intuitively achievable exit aid for an easier exit.

According to one embodiment, the vehicle includes at least one sensor device for detecting a signal indicating a passenger's wish to get out of the vehicle. The control device is configured to evaluate the signal for detecting an exit wish and to actuate the device for holding the vehicle door in the position just taken when an exit wish is detected.

This is based on the finding that on a vehicle door, such as via a door handle of the vehicle door, a pulling aid can be provided to make it easier for a vehicle occupant to get out of the vehicle, when the vehicle door is sufficiently fixed in an open position. When it is detected by sensors that a user wants to get out of the vehicle, the control device actuates the device in such a way that the vehicle door is fixed in a position that has just been taken. A user can thus grasp the vehicle door, for example a door handle, and pull himself out of the vehicle by the door handle, and by means of the device such holding forces are provided, which assist a user when getting out of the vehicle and which hold the vehicle door in the corresponding position.

The at least one sensor device for example can include a capacitive sensor. Such a capacitive sensor can be used to detect, for example, an approach to or a touch of an assembly on which the capacitive sensor is arranged, in order to conclude, on the basis of a sensor signal generated in this way, whether a vehicle occupant possibly just is about to get out of the vehicle.

In one embodiment, a first sensor device is arranged on a body portion of the vehicle body to detect an approach to the body portion or a touch of the body portion by a vehicle occupant. For example, the first sensor device can include a capacitive sensor by which an approach or a touch of the body portion can be detected. When a vehicle occupant touches the body portion, the sensor device generates a sensor signal which can be evaluated by the control device in order to infer an exit wish of a vehicle occupant.

In addition or alternatively, a second sensor device can be arranged on the vehicle door, for example on the interior door trim, for example on a door handle of the vehicle door to detect an approach to the door handle or the interior door trim, or a touch of the door handle or the interior door trim by a vehicle occupant. By such a second sensor device, which for example can include a capacitive sensor, it can thus detected whether a vehicle occupant grasps for example an inner door handle of the vehicle door. On the other hand, a sensor signal generated by the second sensor device can be used to infer whether a vehicle occupant is about to get out of the vehicle.

In one or more embodiments, both a first sensor device on a body portion of the vehicle body and a second sensor device on an inner door handle of the vehicle door are provided. The control device here can be configured to detect an exit wish when it is detected on the basis of the sensor signals generated by the sensor devices that a vehicle occupant both touches the body portion, in the region of which the first sensor device is arranged, and the door handle, in the region of which the second sensor device is arranged.

In addition or as an alternative to sensor devices, which possibly are arranged separately to detect an exit wish on the vehicle body or on the vehicle door, for example on the interior door trim, for example on the door handle, there can also be used sensor devices for detecting an exit wish, which anyway are provided for example on the vehicle door, for example hall sensors, a sensor for measuring a motor current of a door driving device, an acceleration sensor, a force sensor or a gyro sensor. Such sensor devices, for example hall sensors, sensors for measuring the motor current, acceleration sensors, force sensors or gyro sensors, can be arranged for example on the vehicle door in order to detect a movement of the vehicle door, possibly to detect a pinch case and thus to control and possibly stop a door movement. Such sensors can also be configured to detect, for example, an adjustment wish of a user, with which a user triggers an adjustment of the vehicle door from a position just taken (open position). Such sensors can also be used to detect whether a user wants to get out of a vehicle and to do so possibly touches the vehicle door.

The detection whether an exit wish is made here can be effected for example by using artificial intelligence (AI), for example by using an algorithm based on neural networks, for example by detecting and evaluating certain patterns (signatures) in sensor signals which indicate a support of the user or a user pulling the vehicle door when exiting. Correspondingly, the control device is designed to detect an exit wish by means of a software using artificial intelligence (AI) on the basis of patterns in one or more sensor signals. When a predetermined pattern is detected in one or more sensor signals, which indicates an exit wish of a user, the control device actuates the device in order to fix the vehicle door in a position just taken.

Instead of software based on artificial intelligence, there can also be used an algorithm which detects certain patterns in one or more sensor signals by conventional methods, for example by a filter method (such as a Kalman filter) or a fuzzy logic method.

Patterns for which the sensor signals are examined can be learned for example by the system itself. In training runs, for example, the system can learn patterns which indicate an exit wish, so that in the subsequent operation a detection of an exit wish can be carried out by means of such learned patterns.

In addition or as an alternative to sensors arranged in or on the vehicle door, there can also be used sensors which are present for example on the vehicle seat. Such sensors can also be used to detect an exit wish in order to for example evaluate sensor signals and to infer with reference to sensor signals, for example, from sensors in the region of the seating surface or the backrest of the vehicle seat, that a vehicle occupant is about to get out of a vehicle. When it is detected for example by means of sensors on a vehicle seat that a user turns toward the open vehicle door and for example moves one leg or both legs out of the vehicle and thus remains seated for a predetermined period of time, this can indicate a desire to exit, which can be detected by sensors, for example, on the seating surface or the backrest of the vehicle seat.

In addition or alternatively, the fixing of the vehicle door by actuating the device can also be triggered by a switch to be operated by a vehicle occupant. Such a switch, for example in the form of a micro-switch, can be arranged, for example, in the region of the door handle of the vehicle door, on a door control panel on the vehicle door, on the vehicle seat, on the door frame or also on the body around the vehicle door or in the region of the dashboard. When the switch is operated, the device for holding the vehicle door is actuated and the vehicle door is fixed correspondingly (with maximum permissible holding force).

Such a switch can also be used to effect the release from the fixed position. Such a switch can also be used, for example, to initiate a closing operation of the vehicle door.

In addition or alternatively, the fixing of the vehicle door can be triggered by actuating the device also via an additional communication device, for example a remote control unit, a mobile phone or another smart device, for example in the form of a wristwatch or the like. Such a communication device is in communication connection with the control device, so that by entering a corresponding control command on the communication device, a vehicle occupant can cause the vehicle door to be fixed in a position just taken, in order to possibly support an exit of the vehicle occupant.

In addition or alternatively, the at least one sensor device can include an interior monitoring system for detecting a gesture and/or position of a vehicle occupant in the vehicle. Such an interior monitoring system for example can be formed by a radar system or a lidar system and serves to detect a position, body posture or gesture of a vehicle occupant in the vehicle. When it is detected for example by means of the interior monitoring system that a vehicle occupant is swinging his legs out of the vehicle and thus is about to exit, an exit wish of a user can be inferred therefrom, so that the control device actuates the device for holding the vehicle door in the position just taken.

A lidar system (abbreviation of: "Light Detection And Ranging") is a system for an optical distance and speed measurement related to a radar system. Instead of radio waves like in a radar system, laser beams are usually employed in a lidar system.

Such an interior monitoring system for example can also track the movement of the eye of a vehicle occupant (so-called "eye tracking") in order to infer an exit wish of a user on the basis of such a detection.

However, an interior monitoring system for example can also include an ultrasonic sensor or a pyroelectric sensor (PIR sensor) for detecting movement or a gesture in the vehicle interior space.

When a desire to exit has been detected, the device is actuated in such a way that the device holds the vehicle door in a position just taken with the maximum permissible holding force. Thus, the vehicle door is fixed, so that a user can grasp the vehicle door and can get out of the vehicle, possibly supported by grasping the vehicle door. In addition to fixing the vehicle door, the control device can trigger further measures. For example, caused by the control device, a longitudinal adjustment device of the vehicle seat can be actuated in order to move the seat back from a front seating position to a retracted position (longitudinally along the longitudinal direction of the vehicle). In the case of a rotatable vehicle seat, the vehicle seat additionally or alternatively can be rotated or deformed about a vertical axis in the direction of the door opening so that a vehicle occupant can get out of the vehicle in a simple way.

In addition or alternatively, when an exit wish is detected, for example a handle on the vehicle body or the vehicle door can be extended from a recessed, first position to an extended, second position, so that the handle is moved from a hidden position to a functional position in which it is possible to grasp the handle.

In one embodiment, the vehicle includes an operating unit to be operated by a vehicle occupant, for example arranged in the region of a center console of the vehicle, via which a control function of the control device for actuating the device for holding the vehicle door in the position just taken can be switched off when a desire to exit is detected. The operating unit thus allows a vehicle occupant to selectively switch the control function on or off. When the control function is switched off, the vehicle door is not retained on exit of a vehicle occupant and thus is not specifically fixed by means of the device.

In one embodiment it is indicated to the vehicle occupant when the device is switched into a mode for supporting an exit of a vehicle occupant and thus the vehicle door is fixed (so-called support mode). For this purpose, one or more display devices can be arranged in or on the vehicle, for example in the form of an acoustic or optical signal transmitter. Switching into the support mode can be indicated by a one-time short signal, for example an acoustic signal. However, a permanent signal, such as an optical signal, can also be generated and issued, which indicates that the device is in the support mode.

In one embodiment, the device for the manual and/or electromotive adjustment of the vehicle door relative to the vehicle body includes an electromotive driving device for driving the vehicle door.

An electromotive driving device can be adapted to be coupled to an output element to be driven by the driving device by means of a coupling-type switching device. In this case, fixing of the vehicle door can be effected by switching the switching device to a coupling state, and the vehicle door is fixed for example due to a self-locking effect of the driving device.

Alternatively, the driving device can also permanently and non-switchably be coupled to an output element so that there is always a flux of force between the vehicle door and the vehicle body. In this case, for example, the driving device cannot be self-locking, and an additional braking device can be provided, which can be switched in order to fix the vehicle door, for example by acting on the output element to be driven by the driving device.

However, such a braking device possibly can also be omitted in the case of a non-self-locking and permanently (non-switchably) coupled driving device. Thus, the vehicle door can be fixed by energizing the driving device in that the driving device is actuated in such a way that a holding torque opposite to a loading force is set by energizing the driving device in order to hold the vehicle door in the position just taken. The motor is thus counteracted and the vehicle door thereby is held in a position just taken.

In one embodiment, the device includes an output element which is moved relative to the vehicle body on adjustment of the vehicle door, a switching device which can be switched between a coupling state and a freewheeling state, and a control device for controlling the switching device. In this case, the switching device is configured to couple the output element with a further assembly in the coupling state and to release it from the further assembly in the freewheeling state in such a way that the output element can be moved relative to the further assembly. Hence, when an exit wish of the vehicle occupant is detected by means of at least one sensor device and the control device, a power transmission line can be established between the vehicle door and the vehicle body by switching the switching device into its coupled state so that the output element is fixed and the vehicle door is thereby held in a position just taken.

The further assembly for example can be an electromotive driving device which is operatively connected to the output element in the coupling state of the switching device. Due to the fact that the output element is moved on adjustment of the vehicle door, the vehicle door can be fixed via the driving device in the coupling state of the switching device, in that for example a self-locking feature exists on the driving device and the driving device thus retains the output element in the non-energized state or in that the driving device is energized to apply a counterforce against an adjustment of the vehicle door.

Alternatively, the further assembly can also be a housing portion to which the output element is fixed in the coupling state by means of the switching device.

Depending on whether an exit wish of a vehicle occupant is detected by means of the sensor device and the control device, the switching device is thus transferred into its coupling state and the vehicle door is thus fixed in an open position just taken, so that a user for example can grasp a door handle and get out of the vehicle with the aid of the door handle.

The switching device may include at least one switching element which is adjustable to switch the switching device between the coupling state and the freewheeling state. The switching device also may include an electromotive actuating drive for adjusting the at least one switching element, which is controlled via the control device. For example, the switching device can comprise two switching elements in the form of brake shoes which can be adjusted between different positions by means of the actuating drive in order to adjust the switching device between the coupling state and the freewheeling state.

In one embodiment, the switching device may include a brake pot, an adjusting element, for example in the form of a cam, for adjusting the at least one switching element, and a carrier, to which the brake pot is rotatable and on which the adjusting element and the at least one switching element are adjustably arranged. An actuating gear connects the actuating drive with the adjusting element for adjusting the at least one switching element.

In another embodiment, the adjusting element is configured in the manner of a cam and is pivotally arranged on the carrier. The adjusting element for example can cooperate with a pair of switching elements in order to urge the switching elements into contact with the brake pot or to bring them out of contact with the brake pot.

As an example, the at least one switching element can be moved between different positions in order to bring the switching device into its different states.

For example, when the adjusting element is pressed against the at least one switching element to such an extent that the at least one switching element comes into pressing, blocking contact with the brake pot, the switching device is in the coupling state in which a relative movement between the brake pot and the switching elements is blocked so that the brake pot is kept stationary relative to the carrier on which the at least one switching element is arranged. In this coupling state, for example, power can be transmitted between the transmission parts associated to the switching device.

When an exit wish is detected, the at least one switching element is pressed into contact with the brake pot via the adjusting element such as with such a great force that the forces of a vehicle occupant (caused, for example, by touching the vehicle door) can be effectively absorbed and dissipated when exiting the vehicle without the switching device slipping through.

In the freewheeling state, on the other hand, the at least one switching element for example is not in contact with the brake pot in a braking manner. In the freewheeling state, the at least one switching element is offset relative to the brake pot in such a way that the brake pot is not blocked with respect to the at least one switching element and freewheeling of the brake pot relative to the at least one switching element is possible.

In a braking state (which is intermediate between the coupling state and the freewheeling state), the adjusting element urges the at least one switching element for example into a braking, sliding contact with the brake pot so that the brake pot can slidingly move with respect to the at least one switching element, but is braked in its movement. The adjusting element may be shaped like a cam, so that the position of the adjusting element can be used to adjust the braking effect, between a weak braking effect via a strong braking effect up to blocking.

In one embodiment, the at least one switching element is pivotally arranged on the carrier. However, this is not absolutely necessary. It is also conceivable and possible to shiftably mount the at least one switching element for example on the carrier.

In one embodiment, an actuating gear of the switching device is formed by a spindle gear, which includes a spindle and a spindle nut in threaded engagement with the spindle, which are movable relative to each other for adjusting the at least one switching element. The use of a spindle gear for coupling the actuating drive with the at least one switching element provides for a power transmission line between the actuating drive and the at least one switching element with little play. Large adjustment forces can be transmitted via the spindle gear with a small stroke. A spindle gear can also be realized with little installation space and can be operated with low noise. Due to the coupling of the spindle nut via a threaded engagement with the spindle, tensions in the system can be reduced.

To drive the spindle, the actuating drive may drive a drive worm, which for example is in meshing engagement with a pinion connected to the spindle. The drive worm for example can be arranged on a shaft which can be driven by the actuating drive and is thus rotated via the actuating drive.

The drive worm includes a worm thread which is in meshing engagement with a toothing of the pinion, for example a helical gear of the pinion, so that a rotational movement of the drive worm is converted into a rotary movement of the pinion. The axis of rotation of the drive worm and the axis of rotation of the pinion may be (approximately) perpendicular to each other.

To adjust the at least one switching element, the actuating drive drives the actuating gear, for example by putting the spindle into a rotary movement relative to the carrier and by moving the spindle nut longitudinally along the spindle. For example, the spindle nut is coupled to a lever which is connected to the adjusting element and which transmits a movement of the spindle nut into a pivoting movement of the adjusting element.

For example, an adjustable part articulated to the vehicle body can be configured in the manner of a catch strap. The output element, on the other hand, can be realized for example as a rotatable cable drum which is coupled to the adjustable part via a power transmission element in the form of a traction cable (exclusively) transmitting tractive forces. On adjustment of the adjustable part, the cable drum is moved along the adjustable part and twists in the process. An electromotive adjustment of the vehicle door relative to the vehicle body can be effected by driving the cable drum. By decoupling the transmission, the cable drum can be switched into a freewheeling mode, so that a manual adjustment of the adjustable part is also possible, independent of a driving device driving the cable drum.

An acceleration sensor for detecting an acceleration at the vehicle door and/or a gyro sensor for detecting an angular velocity at the vehicle door can additionally be arranged at the vehicle door. Such sensor devices can be used to detect an adjustment wish on the vehicle door in order to actuate the device electromotively or manually for adjusting the vehicle door in dependence on a detected adjustment wish. When an adjustment wish is detected, a switching device for example can be transferred from its coupling state into the freewheeling state, so that a manual adjustment of the vehicle door is possible.

For example, an acceleration sensor and/or a gyro sensor can be used to detect whether a vehicle occupant touches the vehicle door and tries to move the vehicle door. Such contact leads to an acceleration at the vehicle door, which can be evaluated by the acceleration sensor and/or the gyro sensor in order to infer an adjustment wish.

Such detection of an adjustment wish can also be combined—within the control software of the control device—with the detection of an exit wish. For example, when an exit wish of a vehicle occupant is detected, the device for holding the vehicle door in a position just taken is actuated and the vehicle door thus is fixed in such a way that, for example, tensile forces on the vehicle door in the direction of closing the vehicle door do not lead to an adjustment of the vehicle door, and the vehicle occupant thus can grasp the vehicle door in order to get out of the vehicle. The detection of a manual adjustment wish can be excluded in this case.

Alternatively, on detection of an exit wish an adjustment wish in the direction of a (further) opening of the vehicle door can be admissible, but an adjustment wish in the direction of a closing of the vehicle door can be blocked (inadmissible). For example, if, when a vehicle occupant exits the vehicle, it is detected that the vehicle occupant presses on the vehicle door in order to further open the vehicle door, this can be detected as an adjustment wish to open the vehicle door, and the vehicle occupant may be allowed to manually open the vehicle door to a more open position of the vehicle door. When, on the other hand, tensile forces are detected at the vehicle door in the direction of a closing of the vehicle door, this is not interpreted as an adjustment wish, but the vehicle door remains fixed to enable a user to get out of the vehicle.

Possibly, other sensor devices can also be arranged for example in the power transmission line of the driving device, in order to detect an adjustment wish.

BRIEF DESCRIPTION OF THE DRAWINGS

The idea underlying the invention will be explained in detail below with reference to the exemplary embodiments illustrated in the Figures, in which.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A door driving device known from DE 10 2015 215 627 A1 includes a switching device which serves to switchably connect an output element in the form of a cable drum to a driving device so that a vehicle door can be moved relative to the vehicle body by introducing force into the output element. For an operative connection between the driving device and the output element the switching device is switched into a coupling state. To manually adjust the vehicle door independent of the driving device, the switching device can be switched into a freewheeling state in which the operative connection between the output element and the driving device is eliminated so that the vehicle door can be freely adjusted by a user.

Getting out of a vehicle can be cumbersome, depending also on the type of construction of the vehicle. In particular in vehicles with a flat chassis, it is therefore desirable to make it as easy as possible for a passenger to get out of the vehicle.

Frequently, a vehicle occupant who wants to get out of a vehicle intuitively grasps an inner door handle of an open vehicle door in order to use the door handle as an exit aid. However, because the vehicle door usually is not fixed sufficiently, the door handle conventionally is unsuitable as a pulling aid.

Figure 1:
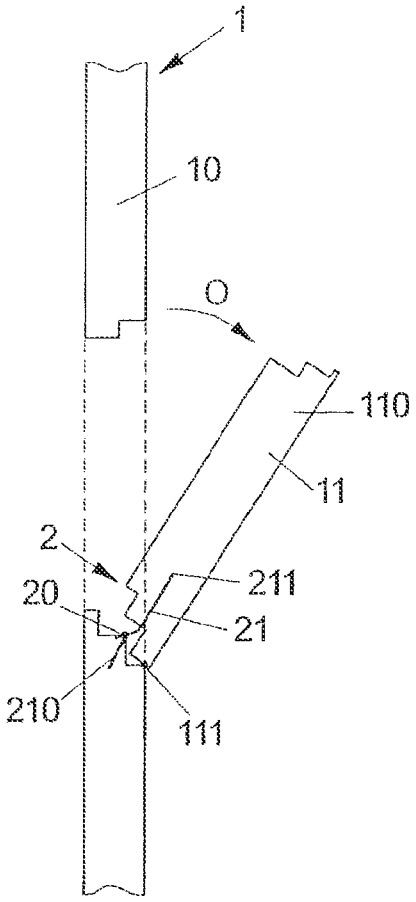
FIG. 1 shows a schematic view of a vehicle door on a vehicle body, comprising an adjustable part in the form of a catch strap which is articulated to the vehicle body and which on pivoting of the vehicle door is moved relative to the vehicle body.
Figure 2:
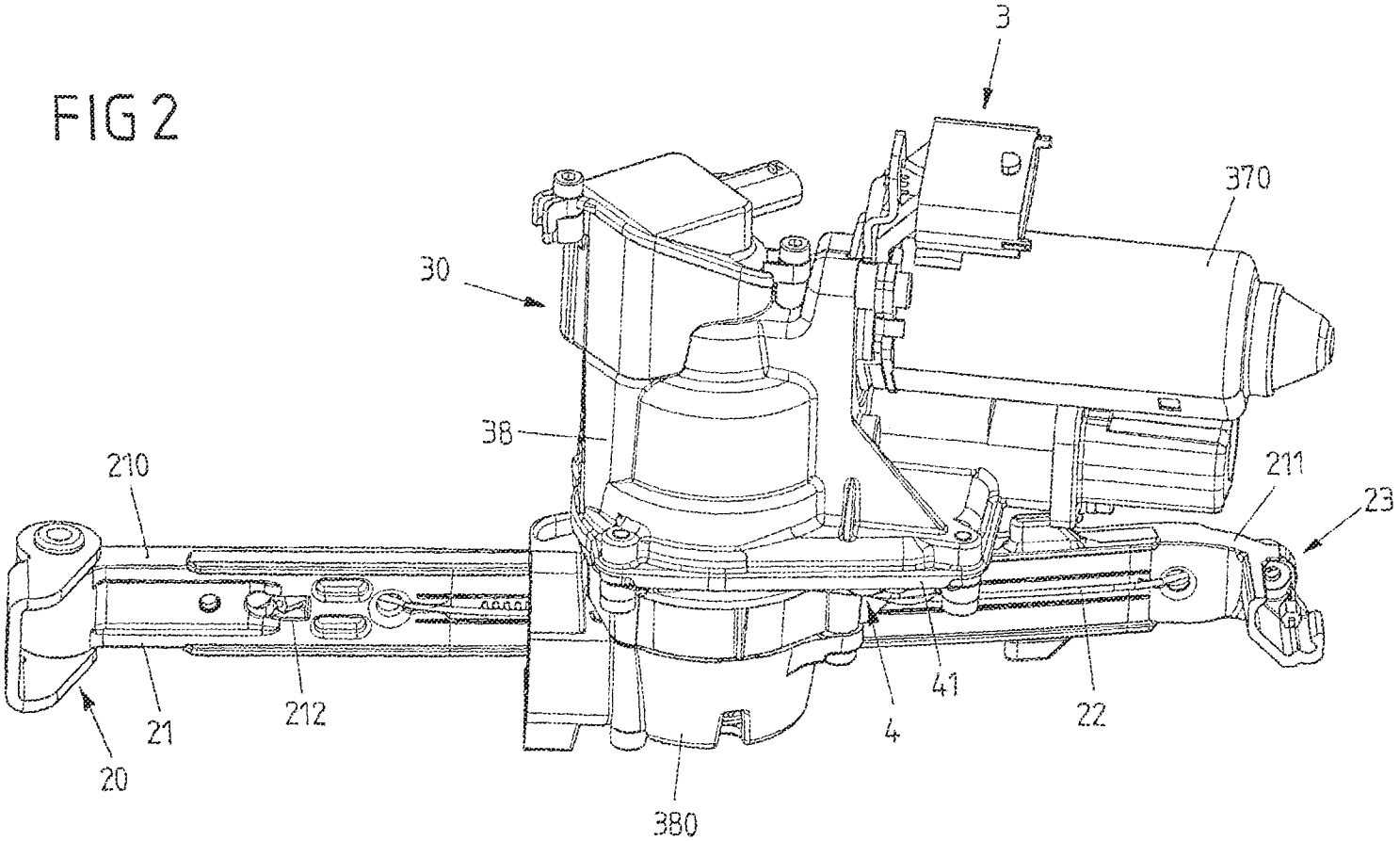
FIG. 2 shows a view of an exemplary embodiment of a device for adjusting and fixing a vehicle door.

FIG. 1 shows a schematic view of a vehicle 1 comprising a vehicle body 10 and a vehicle door 11 articulated to the vehicle body 10 about a door hinge 111, which can be pivoted relative to the vehicle body 10 along an opening direction O in order to open or close a door opening.

What acts between the vehicle body 10 and the vehicle door 11 is a device 2 which includes an adjustable part 21 in the form of a catch strap and serves for fixing and/or adjusting the vehicle door 11 relative to the vehicle body 10. The adjustable part 21 in the form of the catch strap is articulated to the vehicle body 10, for example to the A-pillar of the vehicle 1, about a joint 20 and on pivoting of the vehicle door 11 moves relative to the vehicle door 11. With one end 211 the adjustable part 21 therefor protrudes into a door inner space 110 of the vehicle door 11 and on adjustment of the vehicle door 11 moves in this door inner space 110.

Perspective views of an exemplary embodiment of a device 2 of this type are shown in FIGS. 2 to 6. The adjustable part 21 in the form of the catch strap carries a joint 20 at one end 210, which joint can be fixed to the vehicle body 10, for example to the A-pillar of the vehicle 1, in order to articulate the adjustable part 21 to the vehicle body 10 in this way.

With its end 211 facing away from the end 210, the adjustable part 21 extends into the door inner space 110 of the vehicle door 11. The adjustable part 21 is operatively connected to the vehicle door 11 in order to fix the vehicle door 11 in an assumed adjustment position relative to the vehicle body 10 and/or to enable an electromotive or manual adjustment of the vehicle door 11 relative to the vehicle body 10.

Figure 4:
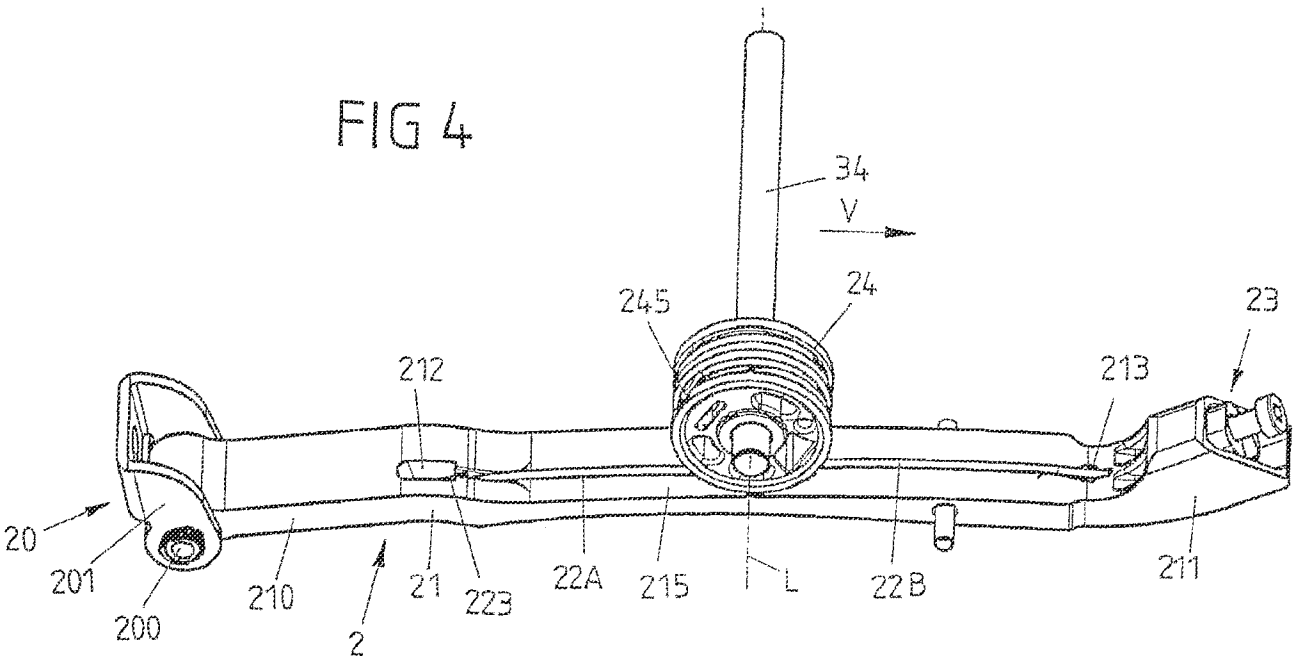
FIG. 4 shows a view of an assembly of the device comprising an adjustable part, a traction cable arranged on the adjustable part and a cable drum connected to the traction cable.
Figure 6:
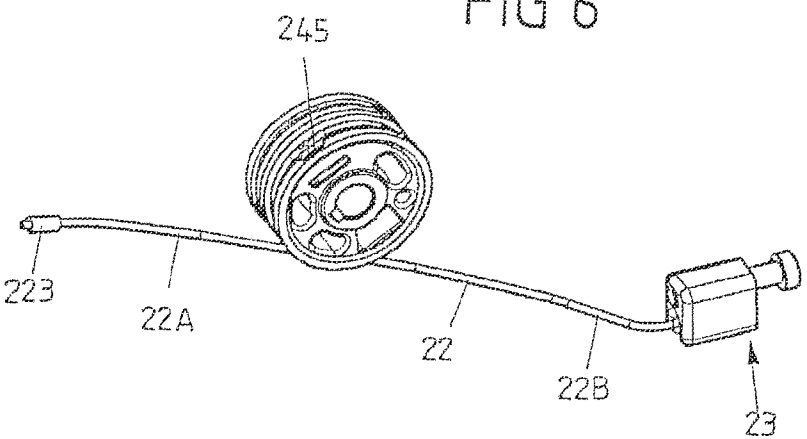
FIG. 6 shows a separate view of the cable drum with a traction cable arranged thereon.
Figure 5:
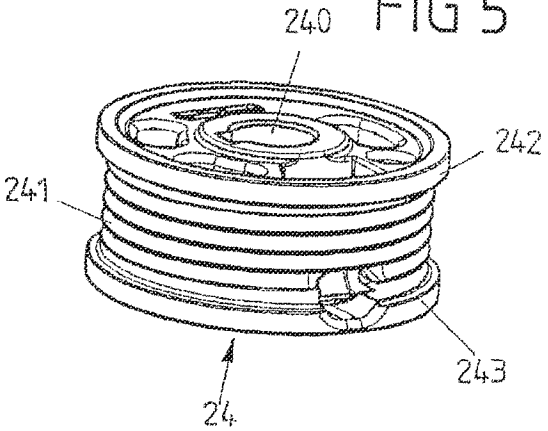
FIG. 5 shows a separate view of the cable drum.
Figure 7:
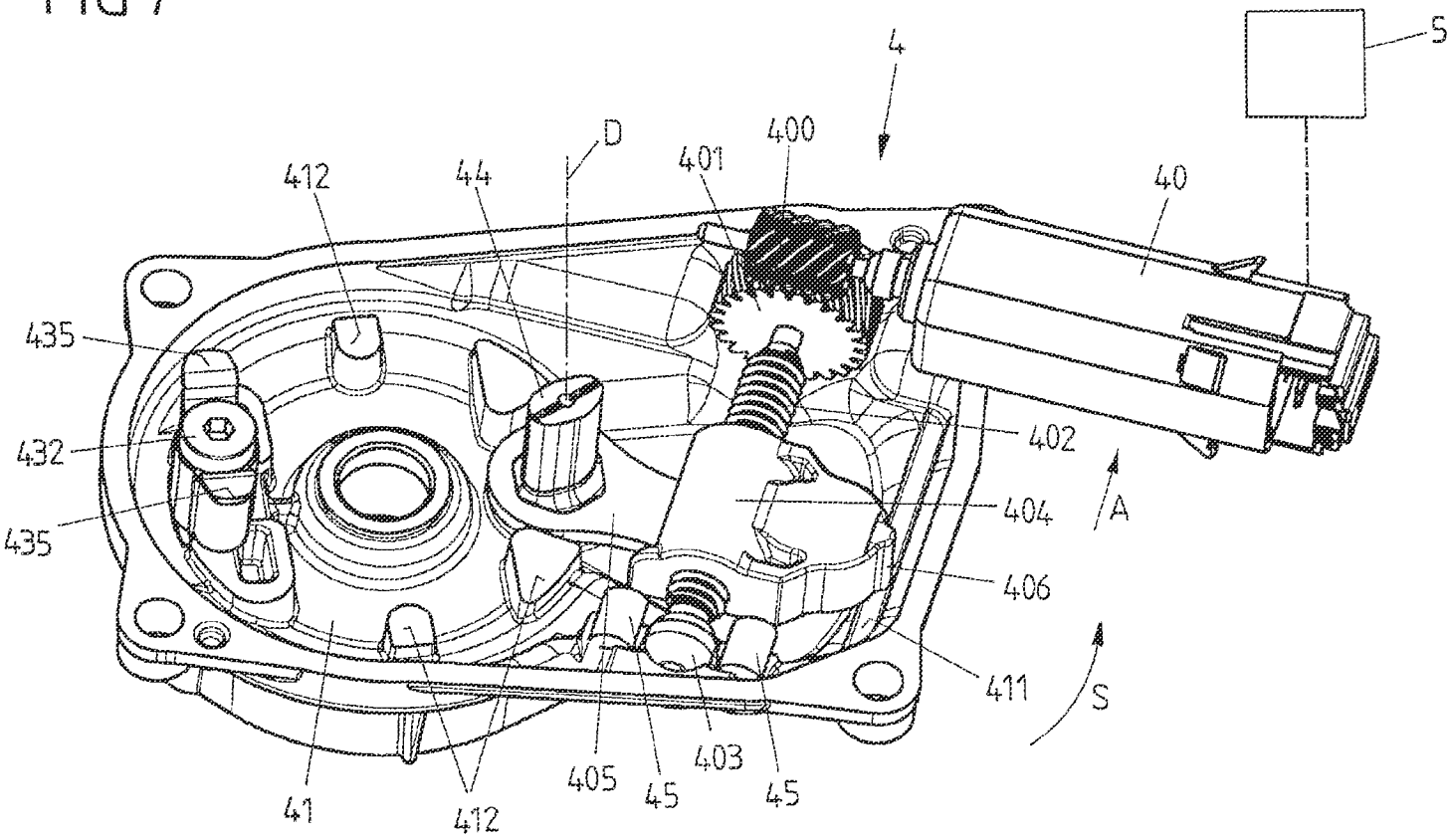
FIG. 7 shows a view of a switching device for switching the transmission.

An exemplary construction of an assembly of this device 2 which establishes the operative connection between the vehicle door 11 and the vehicle body 10 is shown in FIGS. 4 to 6.

A flexible force transmission element transmitting tensile forces in the form of a traction cable 22, for example a steel or plastic cable, is arranged on the adjustable part 21. The traction cable 22 has two different, separately formed portions 22A, 22B, which are connected to the adjustable part 21 on the one hand and to an output element in the form of a cable drum 24 on the other hand.

The portions 22A, 22B extend along a running surface 215 of the adjustable part 21 and are partially wound on the cable drum 24. The first portion 22A of the traction cable 22 extends between a fastening device 212 of the adjustable part 21 and the cable drum 24 and is positively inserted into the fastening device 212 with a cable nipple 223 at one end of the cable, which fastening device is designed as a nipple chamber. The other, second portion 22B extends between the cable drum 24 and an adjusting device 23, which serves to adjust the freely extended length of the traction cable 22 at the adjustable part 21.

The cable drum 24 is arranged on a shaft 34 extending longitudinally along a longitudinal axis L and is rotatable around the longitudinal axis L. As can be taken from the separate view in FIG. 5, the cable drum 24 includes a cable groove 241 extending around the cable drum 24 in the manner of a thread groove, in which the portions 22A, 22B are inserted. This cable groove 241 is bounded on both sides by raceways 242, 243, with which the cable drum 24 abuts against the running surface 215 of the adjustable part 21 in such a way that when the cable drum 24 is rotated around the longitudinal axis L, the cable drum 24 rolls on the running surface 215 of the adjustable part 21.

When the cable drum 24 is rotated around the longitudinal axis L, one of the portions 22A, 22B (depending on the direction of rotation) is wound on the cable drum 24, while the other portion 22B, 22A is unwound from the cable drum 24. The traction cable 22 does not change its extension length on the adjustable part 21. Rather, the rotation of the cable drum 24 leads to an adjustment of the adjustable part 21 along an adjustment direction V relative to the cable drum 24 so that by driving the cable drum 24 the adjustable part 21 and hence the vehicle door 11 can be moved. Alternatively, the cable drum 24 can also be used to provide a braking effect—in the case of a manual adjustment of the prefabricated parts 10, 11 relative to each other—in order to fix the vehicle door 11 in a position just taken or to influence the adjusting movement by braking during the adjustment.

The cable drum 24 is positively and hence non-rotatably connected to the shaft 34. In the illustrated exemplary embodiment, the shaft 34 is part of a transmission 30, which can be used to act on the cable drum 24 for adjusting or fixing purposes. The cable drum 24 is enclosed in a cable drum housing 380 which is firmly connected to a housing 38 of the device 2. The cable drum housing 380 rotatably supports the cable drum 24 and also serves for the defined guidance of the cable drum 24 relative to the adjustable part 21.

The cable drum 24 is coupled to a driving device 3 which includes the transmission 30 and is designed in such a way that the vehicle door 1 can electromotively be adjusted by means of the driving device 3 or manually independently of the driving device 3 or also in the manner of a servomotor electromotively supported by the driving device 3. In the illustrated exemplary embodiment, as shown in FIG. 3, the transmission 30 is designed as a single-stage planetary gear unit and includes a planetary gear stage 32 comprising planetary gears 321, which are arranged on a carrier element 320 non-rotatably connected to the shaft 34 so as to be rotatable about axes of rotation 322 and are in meshing engagement with an internal toothing 312 on a ring gear 31.

Figure 3:
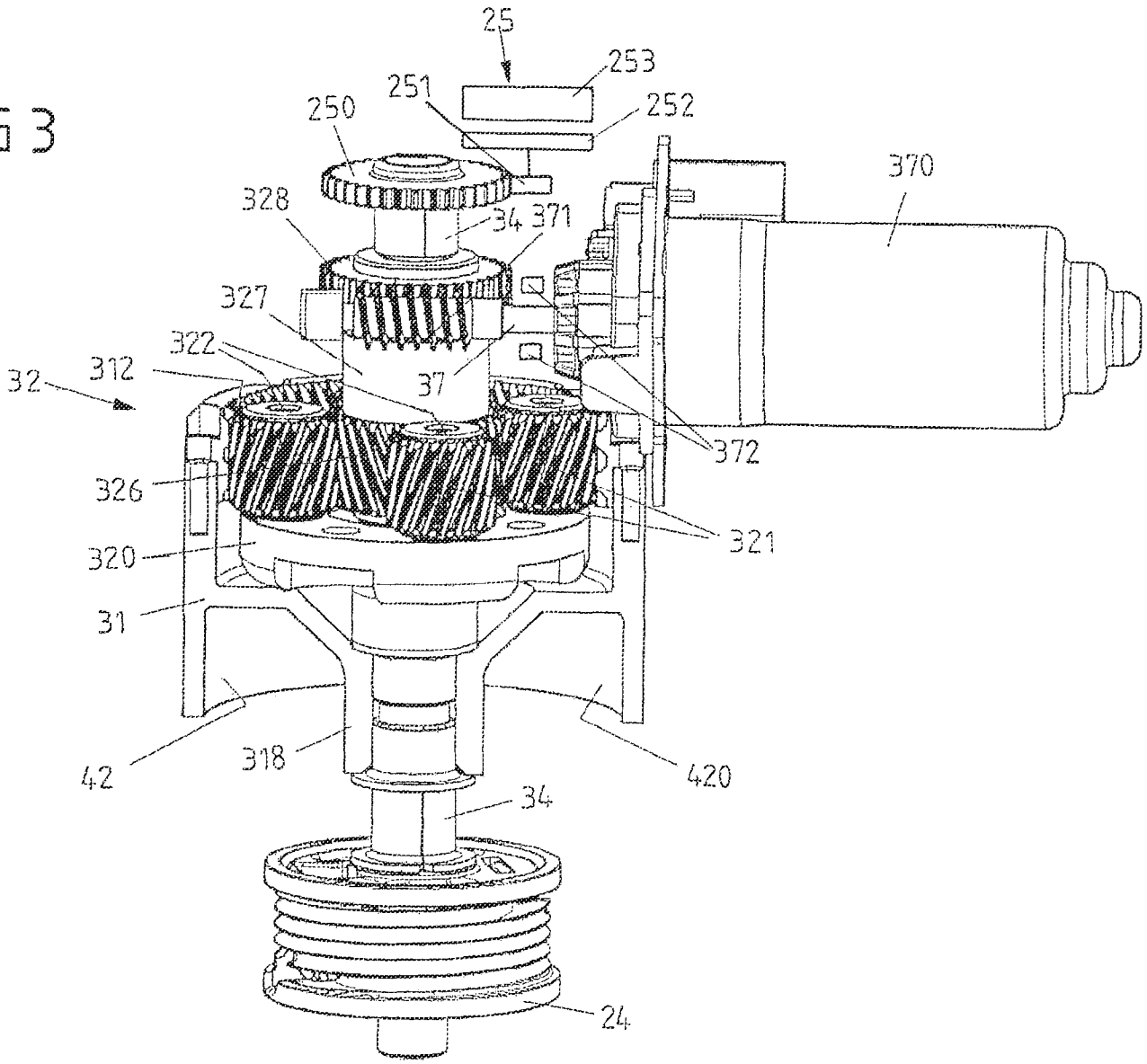
FIG. 3 shows a view of the drive train of the device.

The planetary gears 321 are axially rotatably mounted between two carrier elements 320, of which only a lower carrier element 320 is shown in FIG. 3. The carrier for the planetary gears 321 is thus formed by two carrier elements 320, between which the planetary gears 321 are rotatably arranged.

The planetary gears 321 mesh with a sun gear 326, which is arranged on a hollow shaft 327. The hollow shaft 327 is arranged on the shaft 34 so that it rotates freely and forms a spur gear 328 which meshes with a drive worm 371 on a motor shaft 37 driven by a drive motor 370. The hollow shaft 327 may be formed integrally with the sun gear 326 molded thereto and the spur gear 328. In principle, however, a multi-part design is also conceivable and possible.

The ring gear 31 forms the internal toothing 312 for meshing with the planetary gears 321. The ring gear 31 here is rotatably mounted on the shaft 34 via a bearing portion 318 in the form of a bearing bush and forms a brake pot 42 at an axial end facing away from the internal toothing 312, in which switching elements 430, 431 of a switching device 4 are arranged, which—driven by an actuating drive 40—are adjustable between different states.

Figure 8B:
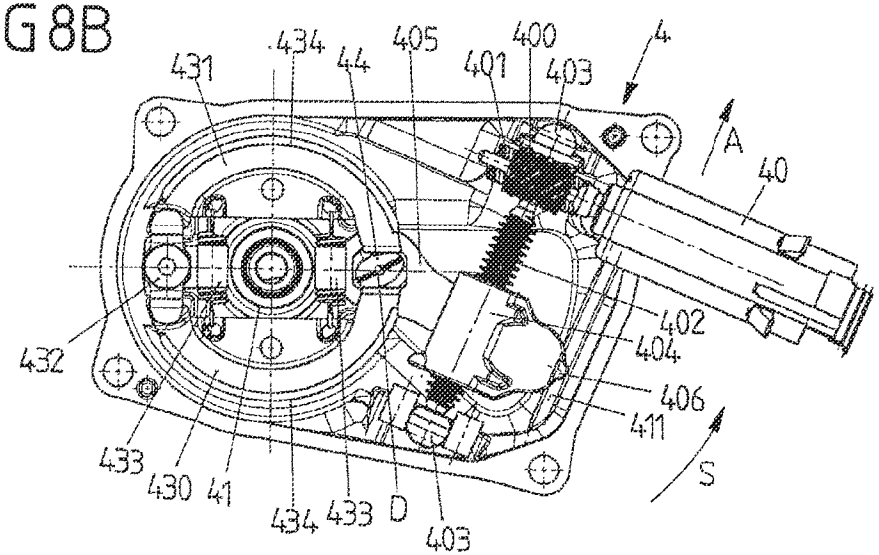
FIG. 8B shows a view of the switching device, in a braking state.
Figure 8A:
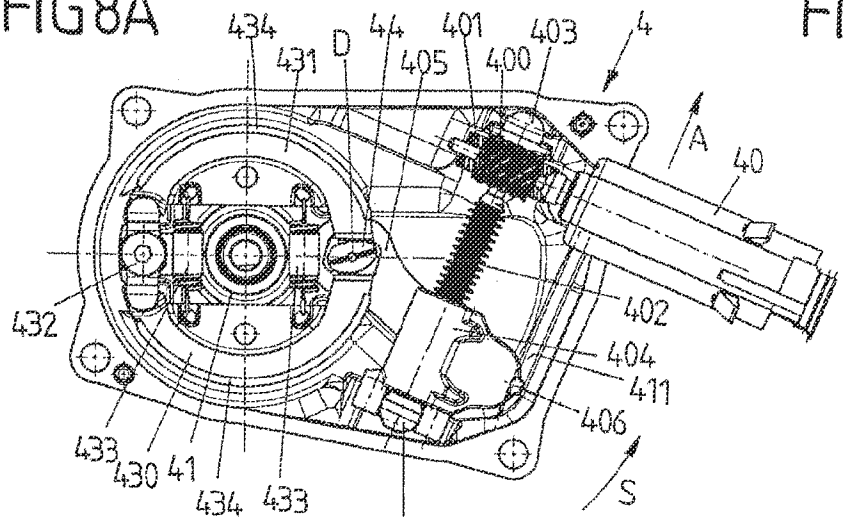
FIG. 8A shows a view of the switching device, in a coupling state.
Figure 8C:
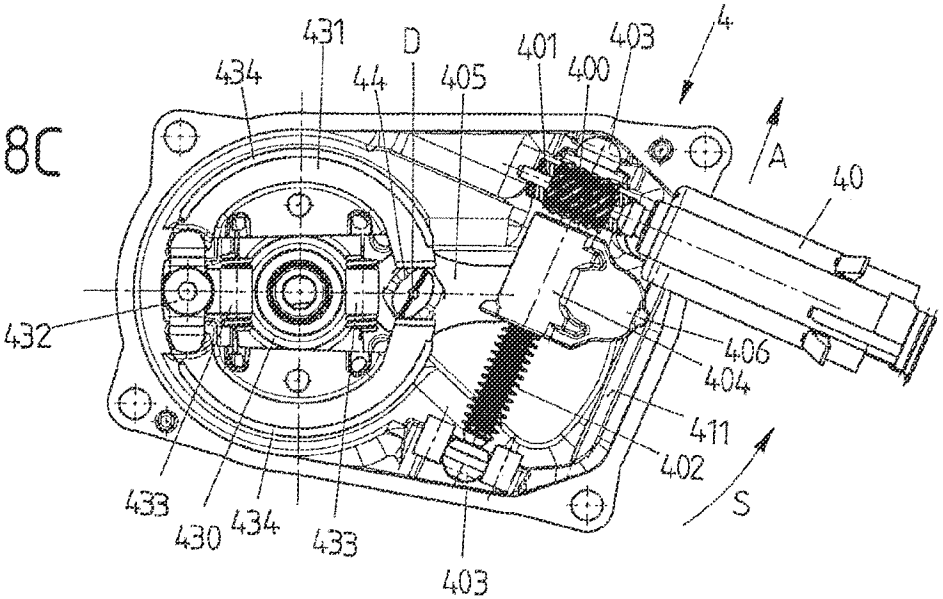
FIG. 8C shows a view of the switching device, in a freewheeling state.
Figure 10:
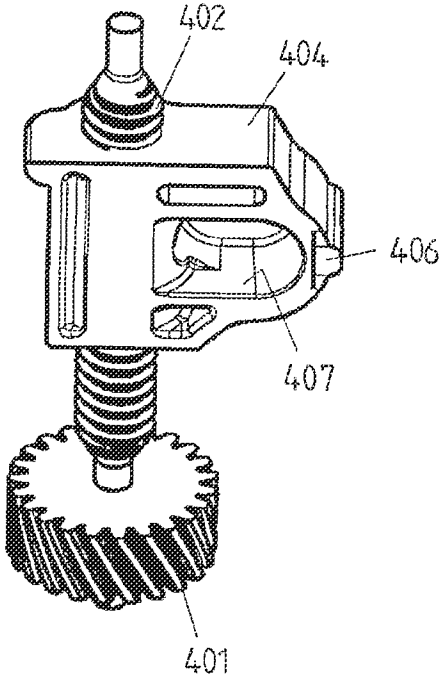
FIG. 10 shows a separate view of a spindle gear unit of the switching device, comprising a spindle to be driven via an actuating drive and a spindle nut in threaded engagement with the spindle.
Figure 9:
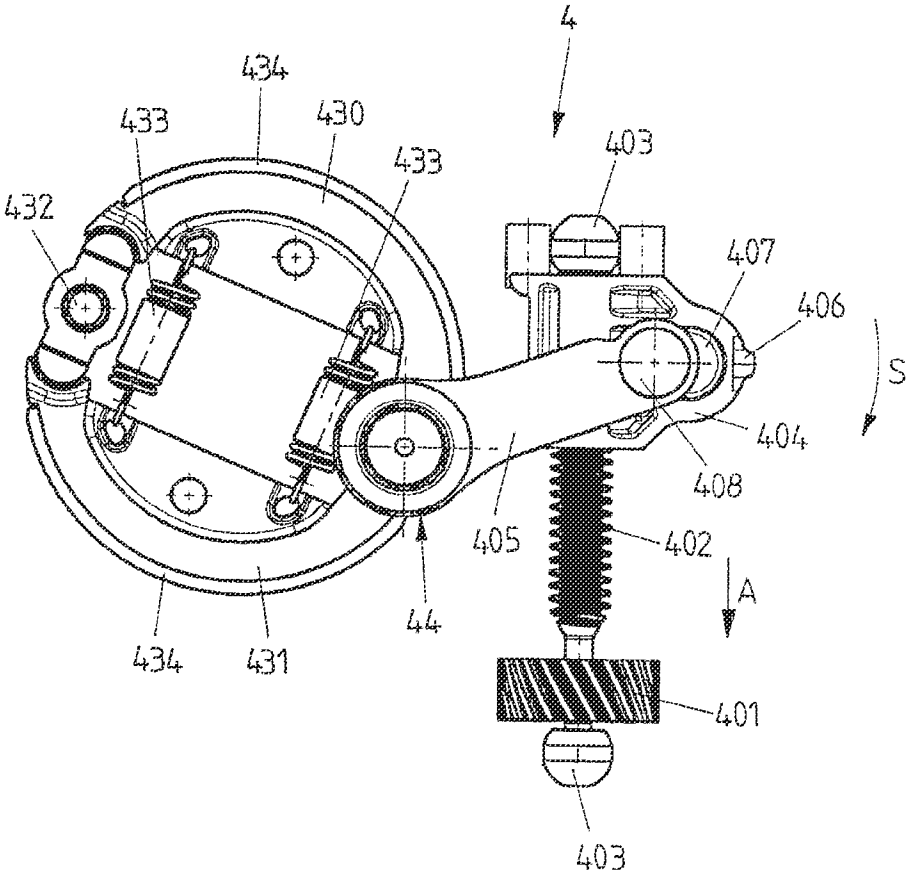
FIG. 9 shows a view of the switching device from below without the carrier element.

The switching device 4 shown in FIGS. 7 to 10 in an exemplary embodiment is configured in the manner of a drum brake and is shown in different functional states in FIGS. 8A to 8C. The switching elements 430, 431 in the form of brake shoes with brake linings 434 arranged thereon are arranged on a carrier 41 formed by a housing part, which is stationarily arranged relative to the housing 38. The brake shoes 430, 431 are arranged on the carrier 41 so as to be pivotable about a fixed bearing 432 (see for example FIGS. 7 and 8A-8C) and can be adjusted for switching the transmission 30 between different positions.

For adjusting the switching elements 430, 431 in the form of the brake shoes, an adjusting element 44 in the form of a cam is provided, which is pivotally arranged on the carrier 41 and connected to a lever 405 and can be adjusted via an actuating drive in the form of a spindle gear unit.

The actuating drive in the form of the spindle gear unit includes a spindle 402 and a spindle nut 404 in threaded engagement with the spindle 402, which are movable relative to each other.

At each of its axial ends, the spindle 402 is rotatably mounted relative to the carrier 41, which is part of the housing 38 of the driving device 3, via a crowned spherical bearing 403 and carries a pinion 401 at an end associated to an actuating drive 40 in the form of an electric motor, which pinion is configured as a worm gear with a circumferential helical toothing and is in meshing engagement with a drive worm 400 firmly arranged on a drive shaft of the actuating drive 40.

The spindle nut 404, on the other hand, is guided via a guide portion 406 longitudinally along a direction of movement A to the carrier 41 and, for this purpose, slides via the guide portion 406 comprising a guideway 411 into contact with the carrier 41. A second guideway is formed on a housing half not shown in FIGS. 7 and 8A-8C, which is to be attached to the carrier 41, so that the spindle nut 404 is fixed in its rotational position relative to the bracket 41, but is slidingly guided along the direction of movement A.

The spindle nut 404 is coupled with a lever 405, on which the adjusting element 44 is rigidly arranged. As can be taken from FIGS. 9 and 10, the spindle nut 404 for coupling with the lever 405 includes a coupling device in the form of an oblong hole 407 into which a coupling element in the form of a pin 408 on the lever 405 engages in such a way that a change in position of the pin 408 relative to the spindle nut 404 can be compensated during a longitudinal movement of the spindle nut 404 along the spindle 402.

To adjust the switching elements 430, 431, the actuating drive 40 drives the drive worm 400, which thereby puts the pinion 401 and thus the spindle 402 into a rotary movement. The spindle nut 404—due to its threaded engagement with the spindle 402—thereby is adjusted longitudinally along the direction of movement A to spindle 402, and the lever 405, which can be pivoted about the pivot axis D of the actuating element 44, thus is pivoted along the direction of adjustment S, and hence the actuating element 44 is also pivoted about the pivot axis D.

The switching device 4 can be used to switch the transmission 30 between a coupling state, a braking state and a freewheeling state.

In the freewheeling state (FIG. 8A) the brake shoes 430, 431 are in a freewheeling position and are correspondingly (slightly) disposed at a distance from the brake pot 42 so that the brake pot 42 is not fixed with respect to the housing 38 and no (significant) braking effect is produced by the brake shoes 430, 431. In this freewheeling state, the cable drum 24 in principle can be moved independently of the drive motor 370 without the drive motor 370 being moved along with an output-side movement of the cable drum 24. In this freewheeling state, such as a smooth, manual adjustment of the vehicle door 11 is possible independently of the drive motor 370.

From the freewheeling state, the switching device 4 can be adjusted in that the spindle nut 404 is moved by rotating the spindle 402 in a corresponding direction of rotation, and the adjusting element 44 thereby is pivoted for expanding the switching elements 403, 4031 relative to each other, as can be seen in FIG. 8B. In a braking state, the brake shoes 430, 431 are urged against the inside of the brake pot 42 with a reduced force—as compared to the coupling state —, so that the ring gear 31 is not blocked, but (merely) braked in a defined way. Thus, the ring gear 31 can rotate relative to the carrier 41, but is braked by the frictional abutment of the brake shoes 430, 431 with the brake pot 42.

Such a braking effect can be used to brake the movement of the vehicle door 11, for example, when the vehicle door 11 approaches an end position, such as the maximally open position, during manual adjustment. A defined braking operation can also be used to brake a movement that is too fast, for example, when the vehicle door 11 is slammed shut manually.

In the braking state, the switching elements 430, 431 slidingly and thus brakingly rest against the inside of an associated braking surface 420 of the brake pot 42 (see FIG. 3) so that a braking effect is provided. By further adjusting the spindle nut 404 in the direction of movement A, the adjusting element 44 is further rotated about its pivot axis D, as this is shown in FIG. 8C, so that the switching elements 430, 431 are pressed into abutment with the brake pot 42 and thereby are frictionally fixed to the brake pot 42. The switching device 4 thus reaches the coupling state in which the brake pot 42 is held stationary relative to the carrier 41.

In the coupling state (FIG. 8C) the brake pot 42 is blocked relative to the housing 38 by the blocking effect of the brake shoes 430, 431, so that the ring gear 31 is fixed relative to the housing 38. In this coupling state, a flux of force is established between the hollow shaft 327 and the cable drum 24 so that the drive motor 370 is coupled to the cable drum 24 via the transmission 30 and the cable drum 24 can be adjusted electromotively.

As shown in FIGS. 8A to 8C, the brake shoes 430, 431 are pretensioned in the direction of their freewheeling position (FIG. 8C) via pretensioning elements 433 in the form of tension springs. To adjust the brake shoes 430, 431 from the freewheeling position, the adjusting element 44 pushes the brake shoes 430, 431 apart and thus in the direction of the brake pot 42. This is effected against the action of the pretensioning elements 433. To return the brake shoes 430, 431 in the direction of the freewheeling position, the adjusting element 44 is pivoted back, and the brake shoes 430, 431 follow the adjusting element 44 due to the action of the pretensioning elements 433 and thus move back in the direction of their freewheeling position.

The adjusting element 44 is formed by a cam which is located between the ends of the switching elements 430, 431 facing away from the fixed bearing 432 and is shaped in such a way that by pivoting the adjusting element 44 about a pivot axis D the switching elements 430, 431 can be pivoted for radial expansion or contraction.

Figure 11:
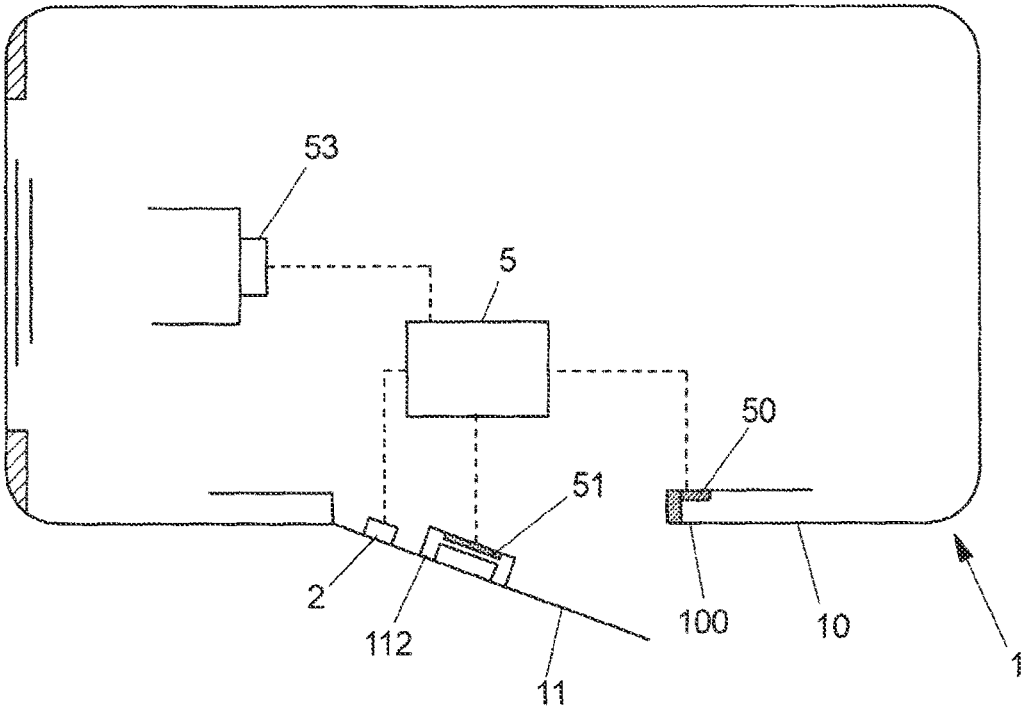
FIG. 11 shows a schematic view of a vehicle comprising a vehicle door and sensor devices in order to detect an exit wish of a vehicle occupant in cooperation with a control device.

FIG. 11 shows a schematic view of a vehicle 1 in which a vehicle side door 11 can be adjusted relative to a vehicle body 10 by means of a device 2, for example, designed in the manner described above.

In the case of a vehicle 1, depending for example on the height of the chassis of the vehicle 1, it can be cumbersome for a passenger to get out, such as when the passenger is physically restricted. For this reason, it is desirable to provide a vehicle occupant with an exit aid in the form of a handle which enables the vehicle occupant to easily get out of the vehicle 1.

For example, a vehicle occupant can intuitively and reflexively grasp an inner door handle 112 of the vehicle door 11 when getting out, in order to use the door handle 112 as an exit aid. A normal procedure is for a vehicle occupant to unlock the vehicle door 11 from the inside and open it manually, in order to then get out of the vehicle 1 while continuing to grasp the door handle 112.

In order to enable the vehicle occupant to pull the door handle 112 and thus assist him/her to get out of the vehicle, it is provided here to fix the vehicle door 11 via the device 2 depending on a detection of an exit wish of a vehicle occupant, so that the vehicle door 11 cannot move when the vehicle occupant pulls the door handle 112.

In the exemplary embodiment as shown in FIG. 11, sensor devices 50, 51 are arranged on the one hand on a body portion 100 of the vehicle body 10, for example in the region of the B-pillar of the vehicle body 10, and on the other hand on the door handle 112 in order to detect by means of the sensor devices 50, 51 whether a vehicle occupant touches the body portion 100 and/or the door handle 112. The sensor devices 50, 51 for example can include capacitive sensors by means of which an approach of a body part, for example a hand, of the vehicle occupant to the body portion 100 or the door handle 112 can be detected, so that sensor signals are generated which can be evaluated by the control device 5 in order to infer an exit wish of the vehicle occupant by means of the evaluation.

For example, the control device 5 can be configured to infer such an exit wish when a vehicle occupant grasps the body portion 100 and the door handle 112 at the same time. When this is the case, it is concluded that the occupant tries to pull out of the vehicle 1, whereupon the control device 5 actuates the device 2 in order to fix the vehicle door 11 in an open position just taken.

When an exit wish is detected, the control device 5 actuates the switching device 4 of the device 2 in order to transfer the switching device 4 into its coupling state. In this coupling state, the driving device 3 arranged on the vehicle door 11 is coupled to the vehicle body 10 via the output element 24 in the form of the cable drum and the adjustable part 21, so that a power transmission line exists between the vehicle door 11 and the vehicle body 10. When the driving device 3 is not energized and moreover is designed to be self-locking, the vehicle door 11 thereby is fixed with respect to the vehicle body 10.

Such a control function for providing an exit aid can be switched on or off by the vehicle occupant via an operating unit 53 arranged, for example, on a center console of the vehicle 1. When a vehicle occupant does not wish to be assisted by adjusting the vehicle door 11 when getting out, he or she can switch off the control function by means of the operating unit 53.

Figure 12:
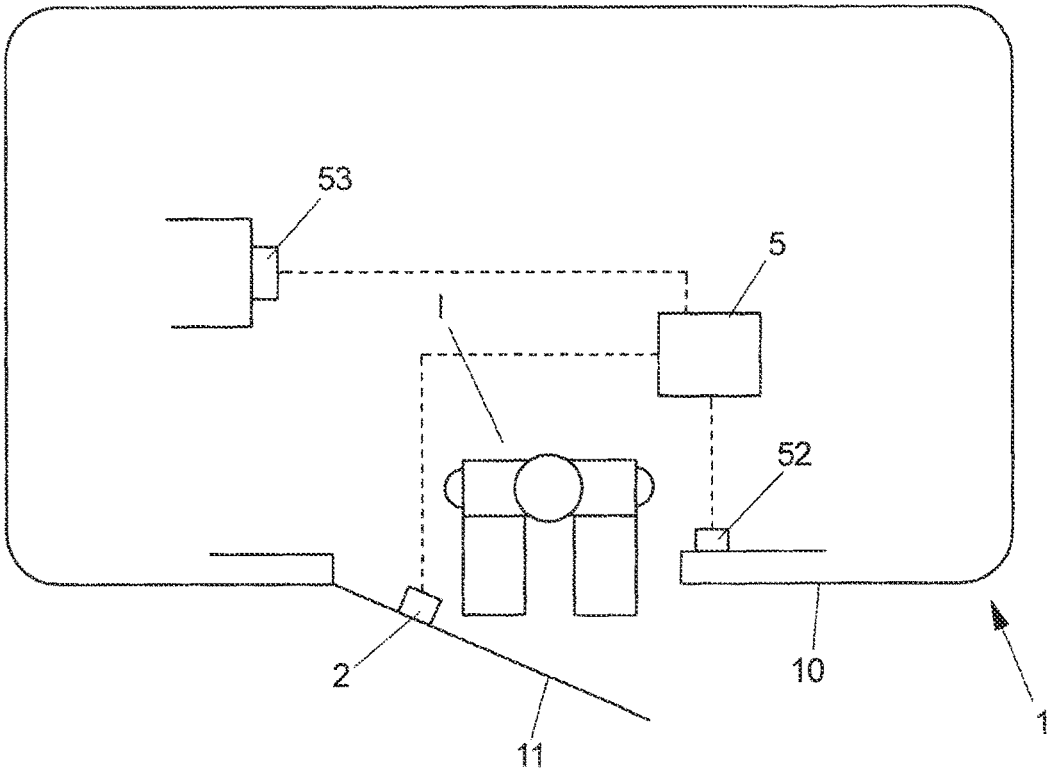
FIG. 12 shows a schematic view of a vehicle comprising a vehicle door and a sensor device in the form of an interior monitoring system for detecting an exit wish of a vehicle occupant.

In another exemplary embodiment shown in FIG. 12 a sensor device 52 in the form of an interior monitoring system using for example a radar system or a lidar system is arranged in the vehicle 1 and cooperates with the control device 5. The sensor device 52 in the form of the interior monitoring system can, for example, detect a position, a body posture or a gesture of a vehicle occupant I in order to infer from such detection whether the vehicle occupant I is about to get out of the vehicle 1. Depending on such a detection, the device 2 in turn is actuated in order to fix the vehicle door 11.

For example, when it is detected by means of the sensor device 52 in the form of the interior monitoring system that the vehicle occupant I is swinging his legs out of the vehicle 1 with the vehicle door 11 open, it can be inferred therefrom that the vehicle occupant I is about to get out. In this case, the control device 5 actuates the switching device 4 of the device 2 to switch into the coupling state so that the vehicle door 11 is fixed with respect to the vehicle body 10.

Again, there is provided an operating unit 53 by means of which this control function can selectively be switched on or off by a vehicle occupant I.

The system of the sensor devices 50, 51 in the exemplary embodiment as shown in FIG. 11 and of the sensor device 52 in the exemplary embodiment as shown in FIG. 12 can be designed to be self-learning, so that in an intelligent way (for example by using artificial intelligence) a common procedure of a vehicle occupant when getting out of the vehicle can be evaluated and be used for control purposes. For example, when it is detected that a vehicle occupant in the exemplary embodiment as shown in FIG. 11 typically touches the sensor devices 50, 51 in a certain sequence when he is about to get out of the vehicle 1, this can be used for a future evaluation.

In addition or alternatively, other sensors in the vehicle, for example on a vehicle seat or on the vehicle door 11, can also be used and their sensor signals can be evaluated in order to detect an exit wish and, depending on such detection of an exit wish, to actuate the switching device 4 to fix the vehicle door 11.

For example, sensor signals of sensors arranged on the vehicle door 11 can be used, for example of a sensor device 25 for detecting the position and speed of movement of the shaft 34 of the device 2 (see FIG. 3). The sensor device 25 includes a spur gear 250 arranged on the shaft 34, which meshes with a spur gear 251 and rotates the same during the rotary movement of the shaft 34. The spur gear 251 is non-rotatably connected to a disk gear 252, which is thus also rotated, and a sensor 253 is designed to detect the (absolute) rotary position of the disk gear 252, which is designed as a magnetic disk for example.

Other sensors can be present, for example, to monitor the motor current of motor the 370. In addition, Hall sensors 372 (see FIG. 3) can be present, for example, which detect the relative movement of the motor shaft 37. Sensors other than angular velocity sensors, acceleration sensors or also force sensors in turn can be present on the vehicle door 11 or on a component associated with the vehicle door 11, by means of which a movement on the vehicle door 11 or on an assembly associated with the vehicle door 11 is detected.

The sensor signals of such sensors—present anyway—can be evaluated, for example, in order to infer an exit wish by means of a pattern recognition in one or more sensor signals. Such pattern recognition can be effected, for example, by using artificial intelligence, and/or classical algorithms, for example filter algorithms (e.g. a Kalman filter) or a fuzzy logic algorithm, can be used additionally or alternatively.

In addition or alternatively, sensors on other vehicle assemblies, for example on the vehicle seat, can also be included in order to infer an exit wish on the basis of sensor signals of such sensors. For example, sensors on a vehicle seat can indicate that a vehicle occupant is about to get out of a vehicle, for example by moving one or both legs out of the vehicle. For example, when a vehicle occupant remains seated on the vehicle seat with one or both legs outside the vehicle for a certain minimum period of time, this can be detected as an exit wish by means of sensors on the seating surface or on the backrest of the vehicle seat, and correspondingly the switching device 4 for fixing the vehicle door 11 can be used to provide a support function.

A switch can also be mounted on the vehicle 1, for example in the region of the vehicle door 11, in the region of the vehicle body 10 around the vehicle door 11, or also in the region of a dashboard of the vehicle 1. The user can operate such a switch when the vehicle door 11 is to be fixed to support the exit. The switch can also be operated by the user when the vehicle door 11 is to be released again from the fixed position, for example to initiate a closing operation of the vehicle door 11.

Switching the support function on and off by fixing the vehicle door 11 can also be triggered by a remote control unit, a mobile phone or another smart device.

When an exit wish is detected, other assemblies of the vehicle 1 can also be actuated. For example, the vehicle seat 11 can be moved back or swivelled (about a vertical axis) or deformed in such a way that a user is assisted in getting out of the vehicle.

When the device 2 is switched to the support mode and the vehicle door 11 is fixed correspondingly, this can for example acoustically or optically be indicated to the vehicle occupant via a display device.

The idea underlying the invention is not limited to the exemplary embodiments described above, but can also be realized in principle in a completely different way.

A door drive for adjusting the vehicle door in principle can be designed completely different from the exemplary embodiment as shown in FIGS. 1 to 10.

For example, to produce a power transmission line between the vehicle door and the vehicle body, it is also possible to use transmission parts other than a cable drum and an adjustable part in the form of a catch strap coupled to the cable drum via a traction element in the form of a cable. For example, the driving device can also be configured as a spindle drive.

Other drive concepts can also be used. Thus, a switching device need not necessarily be provided. It is conceivable, for example, to permanently couple an electromotive drive to a power transmission line, and/or an additional brake for braking a transmission element can possibly be provided in the power transmission line in order to cause the vehicle door to be fixed in a position just taken by means of the brake. However, such a brake possibly can also be omitted in that for fixing the vehicle door the driving device also is actuated in such a way that a holding torque for holding the vehicle door and for counteracting applied load forces is electromotively provided at the driving device.

The following is a list of reference numbers shown in the Figures. However, it should be understood that the use of these terms is for illustrative purposes only with respect to one embodiment. And, use of reference numbers correlating a certain term that is both illustrated in the Figures and present in the claims is not intended to limit the claims to only cover the illustrated embodiment.

LIST OF REFERENCE NUMERALS

1 vehicle
10 body
100 body portion (B-pillar)
11 vehicle door
110 door inner space
111 door hinge
112 door handle
2 device
20 joint
21 adjustable part (catch strap)
210, 211 end
212 fastening device
213 opening
214 guideway
215 running surface
22 flexible power transmission element (traction cable)
22A, 22B cable portion
223 cable nipple
23 adjusting device
24 cable drum
240 opening
241 cable groove
242, 243 raceway
25 sensor device
250, 251 spur gear
252 disk wheel
253 sensor
3 driving device
30 transmission
31 internal gear
312 internal toothing
318 bearing portion
32 planetary gear stage
320 carrier element
321 planetary gears
322 axis of rotation
326 sun gear
327 hollow shaft
328 spur gear
34 shaft
37 motor shaft
370 drive motor
371 drive worm
372 Hall sensors
38 housing
380 cable drum housing
4 switching device
40 actuating drive
400 drive worm
401 pinion
402 transmission element (spindle)
403 spherical bearing
404 transmission element (spindle nut)
405 lever
406 guide portion
407 coupling device
408 coupling element
409 motor shaft
41 carrier

411 guideway
42 brake pot
420 braking surface
430, 431 switching elements (brake shoes)
432 fixed bearing
433 tension springs
434 brake lining
44 adjustable element
5 control device
50-52 sensor device
53 operating unit
A direction of movement
D pivot axis
I vehicle occupant
L longitudinal axis
O opening direction
S actuating direction
V direction of adjustment While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

The invention claimed is:

1. A vehicle including a vehicle body, the vehicle comprising:

a vehicle door adjustably arranged on the vehicle body;

a device configured to perform at least one of manually move the vehicle door relative to the vehicle body and electromotively move the vehicle door relative to the vehicle body;

a number of sensors configured to detect a signal indicative of a vehicle occupant's wish to exit the vehicle; and a control device configured to, responsive to the vehicle door being in a first position in which the door is in an open position, and receiving the signal from the number of sensors, evaluate the signal and actuate the device to hold the vehicle door in the first position.

2. The vehicle of claim 1, wherein the number of sensors include a capacitive sensor.

3. The vehicle of claim 1, wherein a first sensor of the number of sensors is disposed on a body portion of the vehicle body and is configured to detect an approach by the vehicle occupant towards the body portion or a touch by the vehicle occupant of the body portion.

4. The vehicle of claim 3, wherein the signal is based on the approach or to the touch of the body portion.

5. The vehicle of claim 1, wherein a second sensor of the number of sensors is disposed on a portion of the vehicle door and is configured to detect an approach by the vehicle occupant towards the portion of the vehicle door or a touch by the vehicle occupant of the portion of the vehicle door.

6. The vehicle of claim 5, wherein the portion of the vehicle door is a door handle and wherein the signal is based on the approach towards the door handle or the touch of the door handle.

7. The vehicle of claim 1, wherein the number of sensors are either disposed on the vehicle door or on a vehicle seat, wherein the control device is further configured to evaluate the signal based on a pattern recognition.

8. The vehicle of claim 1, wherein the control device is further configured to evaluate the signal by using an algorithm based on artificial intelligence.

9. The vehicle of claim 1, wherein the number of sensors include an interior monitoring system configured to detect at least one of a gesture and a position of the vehicle occupant.

10. The vehicle of claim 9, wherein the interior monitoring system includes a radar system, a lidar system, an ultrasonic sensor or a pyroelectric sensor.

11. The vehicle of claim 1, further comprising:

an operating unit configured to be operated by the vehicle occupant so that the control device is selectively operable or inoperable.

12. The vehicle of claim 1, wherein the device includes an electromotive driving device configured to move the vehicle door.

13. The vehicle of claim 1, wherein the device includes, an output element configured to move relative to the vehicle body as the vehicle door moves, and a switching device configured to be switched between a coupling state, to couple the output element to an assembly, and a freewheeling state to disengage the output element from the assembly so that the output element is movable relative to the assembly, wherein the control device is further configured switch the switching device to the coupling state in response to receiving and evaluating the signal.

14. The vehicle of claim 13, wherein the switching device includes, a switching element, wherein the switching element is adjustable to switch the switching device between the coupling state and the freewheeling state, and an actuating drive configured to adjust the switching element, wherein the control device is configured to control the actuating drive.

15. The vehicle of claim 14, wherein the switching device includes, a brake pot, an adjusting element configured to adjust the switching element, and a carrier, wherein the brake pot is configured to rotate with respect to the carrier, wherein the adjusting element and the switching element are disposed on the carrier and are configured to be adjusted with respect the carrier.

16. The vehicle of claim 15, wherein the adjusting element is configured to pivot about a pivot axis defined by the carrier.

17. The vehicle of claim 15, wherein when the switching element is in the coupling state, the switching element contacts the brake pot such that the brake pot is fixed with respect to the carrier, and when the switching element is in the freewheeling state, the switching element is disengaged from the brake pot such that the brake pot is movable with respect to the carrier.

18. The vehicle of claim 14, wherein the switching device includes a spindle gear unit provided with a spindle and a spindle nut threaded to the spindle, wherein the spindle and spindle nut are movable relative to each other to adjust the switching element.

19. A vehicle access system for use in a vehicle including a vehicle body and a vehicle door, the vehicle access system comprising:

a door drive configured to move the vehicle door between a closed position, an intermediate position, and an open position;

a number of sensors configured to detect a signal indicative of a vehicle occupant's wish to exit the vehicle; and a controller configured to, responsive to the door being in the intermediate position and receiving the signal from the number of sensors, command the door drive to fix the vehicle door in the intermediate position to permit the vehicle occupant to grasp the vehicle door as the vehicle occupant exits the vehicle.

20. A vehicle including a vehicle body, the vehicle comprising:

a vehicle door adjustably arranged on the vehicle body;

a device configured to perform at least one of manually move the vehicle door relative to the vehicle body and electromotively move the vehicle door relative to the vehicle body, wherein the device includes, an output element configured to move relative to the vehicle body as the vehicle door moves, and a switching device configured to be switched between a coupling state, to couple the output element to an assembly, and a freewheeling state to disengage the output element from the assembly so that the output element is movable relative to the assembly;

a number of sensors configured to detect a signal indicative of a vehicle occupant's wish to exit the vehicle; and a control device configured to, responsive to the vehicle door being in a first position and receiving the signal from the number of sensors, evaluate the signal and actuate the device to hold the vehicle door in the first position, wherein the control device is further configured switch the switching device to the coupling state in response to receiving and evaluating the signal.

* * * * *